US005791569A

United States Patent [19]

Ishikawa

[11] Patent Number: 5,791,569

[45] Date of Patent: Aug. 11, 1998

[54] CRUSHING APPARATUS

[75] Inventor: Tsuyoshi Ishikawa, Chuo-ku, Japan

[73] Assignee: Mitsui Mining Company, Limited, Tokyo, Japan

[21] Appl. No.: 868,987

[22] Filed: Jun. 4, 1997

[30] Foreign Application Priority Data

Jul. 1, 1996 [JP] Japan ..... 8-171167

[51] Int. Cl.[6] ..... B02C 17/16

[52] U.S. Cl. ..... 241/74; 241/171; 241/172; 241/180

[58] Field of Search ..... 241/74, 171, 172, 241/179, 180

[56] References Cited

U.S. PATENT DOCUMENTS

| | | | |
|---|---|---|---|
| 4,304,362 | 12/1981 | Buhler | 241/67 |
| 4,347,986 | 9/1982 | Haddon | 241/74 |
| 4,967,968 | 11/1990 | Vitelli | 241/46.17 |
| 5,156,344 | 10/1992 | Tippett | 241/74 X |
| 5,193,754 | 3/1993 | Pujol | 241/65 |
| 5,326,038 | 7/1994 | Nilsson | 241/74 |
| 5,474,240 | 12/1995 | Satomi | 241/74 |
| 5,544,821 | 8/1996 | Gupta et al. | 241/74 X |

*Primary Examiner*—John M. Husar
*Attorney, Agent, or Firm*—Oliff & Berridge, PLC

[57] ABSTRACT

A crushing apparatus for processing of materials in bulk includes a cylindrical separator disposed rotatably in a crushing vessel almost coaxially therewith, wherein the separator partition on interior space of the vessel into an inner and an outer chamber one inside the other about the axis of the vessel. The apparatus also includes a cylindrical agitation unit disposed rotatably in the inner chamber and almost coaxial with the vessel. The separator comprises inner and outer annular rings and a plurality of steel studs in a mutually adjacent arrangement and extending between the inner and outer rings space, thereby defining a plurality of slits or openings therebetween for intercommunication of the inner and outer chambers. The agitation unit has a series of flutes and crowns in alternating orders on the peripheral wall thereof, and each of the flutes has a slit or through-bore intercommunicating the interior and the exterior of the unit. The vessel has an input port for feeding the material in communication with the inner chamber and an output port for discharging the crushed materials out of the outer chamber.

18 Claims, 3 Drawing Sheets

CRUSHING APPARATUS

BACKGROUND OF THE INVENTION

1. Field of the Invention

The present invention related to a crushing apparatus, more particularly, a wet type agitating mill to be used to crush and/or disperse ink and paint pigments, inorganic materials such as ceramics or metals, and medical drug ingredients, etc.

2. Description of the Related Art

There have been proposed various types of wet agitating mills or crushing apparatus to this end.

One known crushing apparatus comprises a cylindrical vessel having an input port at one end and a tubular output port at the other end, a drive shaft disposed rotatable in the middle of the vessel, an agitator disk mounted on the drive shaft at its part disposed within the vessel and rotatable integrally with the shaft, an annular separator plate disposed at the output within the vessel, and a rotatable tubular unit disposed rotatable in the middle of the annular segregation plate, in which a material separator or screening unit is composed of the segregation plate and the rotatable tubular unit.

In operation, the drive shaft is actuated to rotate the agitator disk, while a batch of material feed to be treated is fed by pressure into the vessel through the input port. Then the thus fed material feed is agitated to disperse together with the working media within the vessel, and is circulated from one end to the other end within the vessel.

Then the rotatable tubular unit is driven to rotate, the material feed mixture is separated into the treated material and the working medium by slits defined between the rotatable tubular unit and the annular segregation plate. At this time the medium stays within the vessel and the treated material passes through the slits to be discharged out of the output port.

Such conventional crushing apparatus has an advantage in that the material feed mixture moves in the vessel almost in a condition of piston flow or plug flow, thereby enabling a very efficient crushing work. This advantageous result is achieved because the vessel structure has such a relatively long length in the axial direction and hence L/D ratio, i.e. length to diameter ratio is relatively large.

However, this apparatus has a significant drawback in that flow of the material fed mixture is adversely and substantially limited by the separator, which is located at the distal end of material feed flow in the axial direction in the vessel where the material feed mixture is separated into crushed material and the medium, and thus only small volume of feed mixture can be processed at a time in operation.

With this point in view, another crushing apparatus has been proposed to provide an improved separator to allow for a large capacity of processing of the material feed mixture. However, this known apparatus also has a long axial vessel length, i.e. large L/D ratio, and the separator is located similarly to the prior apparatus at the distal end of flow in the vessel, thereby causing the working medium to be accumulated around the output port of the vessel, which leads to an unstable operation or sometimes a failure of operation.

SUMMARY OF THE INVENTION

It is therefore an object of the present invention to solve these drawbacks experienced in the known crushing apparatus, and more specifically to provide an improved crushing apparatus which enables a stable processing of a large bulk of materials without reducing an efficiency of crushing.

With such drawbacks in view, the present invention proposes a crushing apparatus which comprises: a crushing vessel of a cylindrical configuration having both axial ends substantially closed; a cylindrical separator disposed within and substantially coaxial with the vessel the separator having a plurality of slits disposed in at least some portions of a peripheral wall thereof, the separator parting the interior of the vessel into inner and outer chambers disposed coaxially and one inside the other, and the separator being provided with a plurality of bores for intercommunication between said two chambers; an agitator unit disposed rotatably about the axis of said vessel within said inner chamber; an input port disposed on said vessel for feeding materials to be processed into said inner chamber; and an output port disposed on said vessel for discharging the processed materials out of said outer chamber.

In addition, the crushing vessel has such a configuration that a ratio of the length (L) of the vessel in an axial direction to the diameter (D) of the vessel is not more than 1.0. This means that the ratio is represented by a formula: $L/D \leqq 1.0$.

With this arrangement, the crushing apparatus works suitably enough to prevent an undesirable accumulated flow of the mixture of material feed and crushing media within the inner chamber of the vessel.

In operation, the material feed is first fed into the inner chamber of the crushing vessel via the input port, and then the agitator unit is actuated to rotate. At this time, the agitator means agitates the material feed together with the crushing media of relatively large grain size which had been placed in the inner chamber, and then the mixture fluid of the feed and crushing media is forced to move from the central area of the chamber outwardly. As a result, the feed mixture fluid circulating within the chamber is screened by the separator, where only the properly processed or predetermined size of material granulates are selectively allowed to pass therethrough while the crushing media as well as the rest of material feed of still large grain size are filtered out and remain inside.

BRIEF DESCRIPTION OF THE DRAWINGS

The above and other objects, and advantageous features of the present invention will be apparent from the following detailed description of the preferred embodiments when read with reference to the accompanying drawings.

DESCRIPTION OF THE PREFERRED EMBODIMENTS

Figure 1:
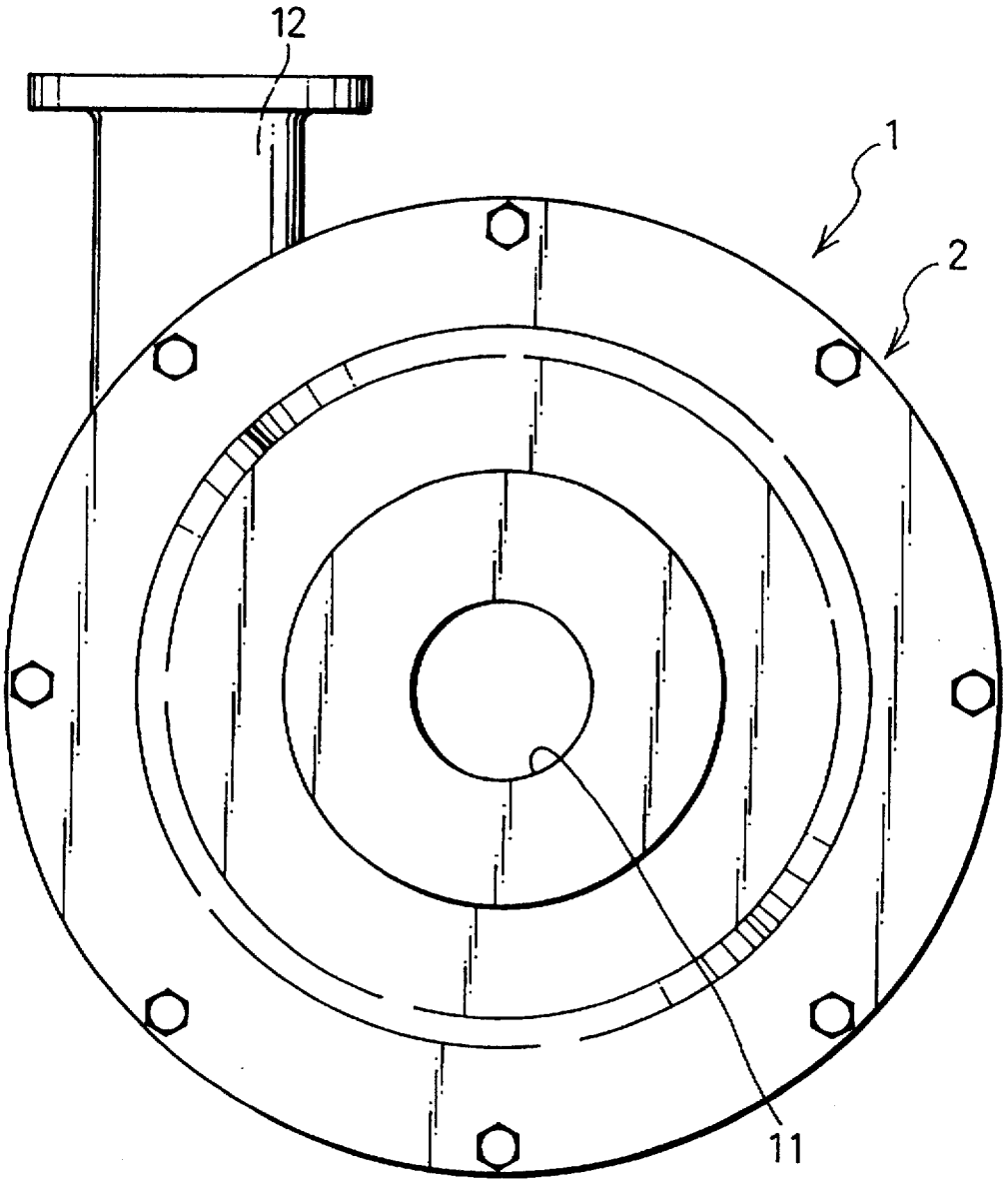
FIG. 1 is an elevational view of the crushing apparatus according to a preferred embodiment of the present invention.
Figure 2:
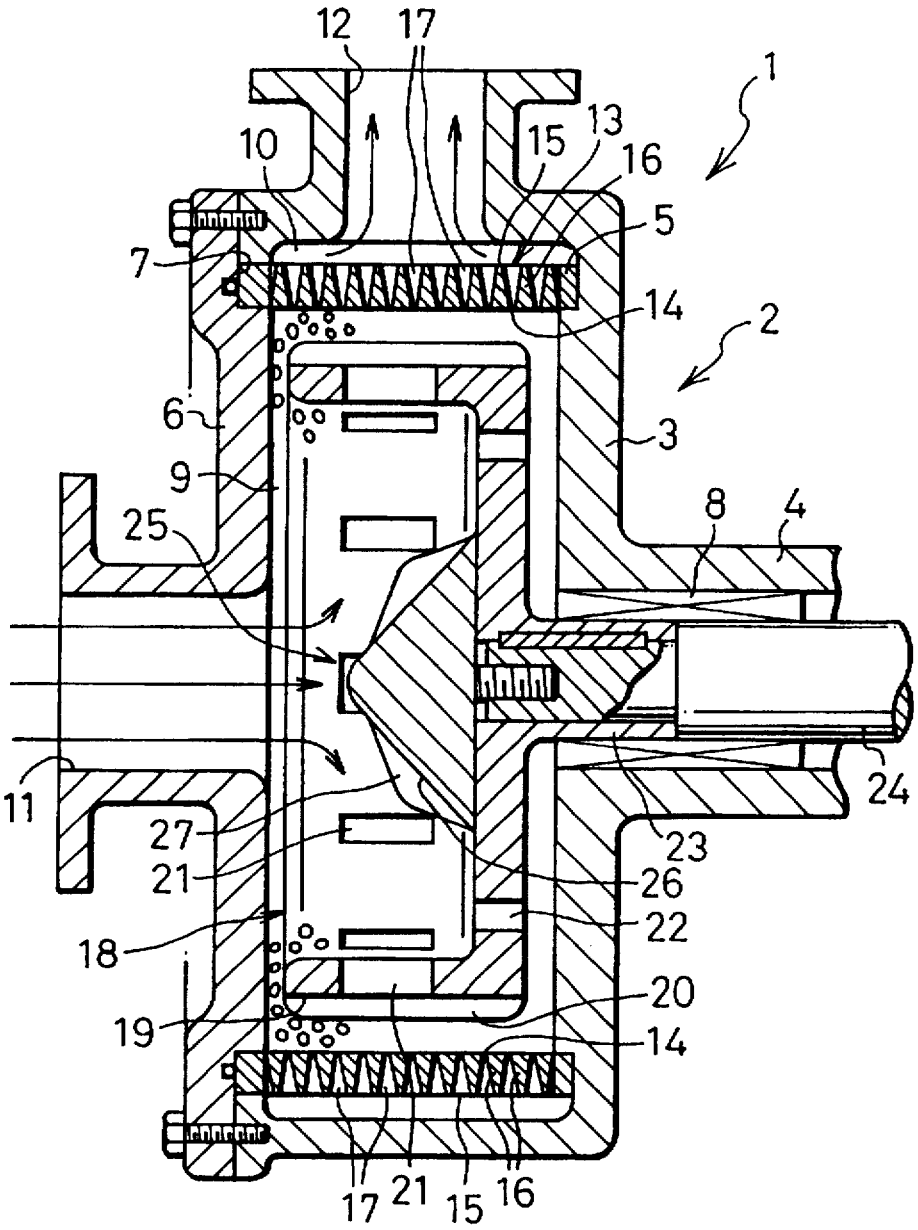
FIG. 2 is a partial cross-sectional side view of FIG. 1 showing the principal parts of the invention.

A crushing apparatus denoted by numeral 1 in FIGS. 1 and 2 is a continuous type of wet media agitator mill. The crushing apparatus comprises a cylindrical vessel or casing 2 having both ends closed, an agitator unit 18 disposed rotatable in the vessel 2 to agitate a material feed and crushing media within the same, and a cylindrical separator 13 disposed in the vessel 2 to separate the feed mixture into the properly treated material and the media.

The vessel 2 includes a cylindrical body 3 having one closed end and other open end, and a circular plate or lid 6 to close the other open end.

The cylindrical vessel body 3 has a boss 4 formed integrally therewith at the center of the closed end, through which the interior space communicate to the exterior. The agitator unit 18 is supported rotatably by the boss 4 via a bearing 8 disposed therein.

An annular groove 5 is formed on the closed wall of the cylindrical vessel body and extending along and an inner peripheral wall, and also another annular groove 7 is formed on the lid 6 to extend along the peripheral end in alignment with the former groove 5. The separator 13 is mounted in the vessel body 3 such that the separator's one end fits in the groove 5 and the other end in the groove 7, and then the lid 6 is fixed to the vessel body 3 by bolts, thereby holding the separator 13 fixedly in the vessel body.

Alternatively, the separator 13 may be fixed onto the interior wall of the vessel body 3 directly by bolts or other fastener means.

The vessel 2 has two chambers which are parted by the separator; an inner cylindrical chamber 9 defined centrally of the cylindrical vessel body 3 by the inner walls of the lid 6 and the vessel body and the separator 13, and an outer annular chamber 10 defined by the separator 13 and the inner peripheral wall of the vessel body 3, the two chambers being disposed coaxial with each other. A cylindrical input port or material feed port 11 is integrally formed at the center of the lid 6 to communicate the interior of the vessel 2 to the exterior thereof in order to feed a bulk material into the inner chamber 9. A cylindrical output port or material discharging port 12 is integrally formed at the annular peripheral wall of the vessel body 3 to communicate the interior of the outer chamber 10 to the exterior in order to discharge the treated material which had come out of the inner chamber 9 through the separator 13 to the exterior of the vessel 2.

The vessel 2 has a structure of a relatively short length. In other words, L/D ratio is relatively small. In this preferred embodiment, the L/D ratio is represented by $L/D \leqq 1.0$, where L is length of the vessel and D is diameter thereof.

Generally to say, a piston flow effect of the material flow decreases and lessens the efficiency of workability if this L/D ratio is lowered. The piston flow is a state of flow in which the material feed and the working media flow in parallel without being mixed with each other. However, in the present embodiment, D (diameter) is increased to such a degree that L (length) is reduced so that the apparatus provides a volume of the inner chamber (or crushing zone) large enough to process a large bulk of loads, thus enabling as much working efficiency as the conventional apparatus has.

The separator 13 includes an inner cylindrical ring 14, an outer cylindrical ring 15 and a plurality of tapered studs 16 of a trapezoidal vertical cross-section extending between the inner and outer rings 14, 15. Studs are made of steel in this embodiment. The studs have a thicker portion at the inner end having a diameter larger than that of the outer end portion, and arranged at regular intervals on the periphery of the inner ring 14. The arrangement of the studs define a plurality of openings or gaps 17 in between. More specifically, four neighboring studs roughly define an opening in between. As each of studs 16 is tapered towards the inner wall of the outer ring 15, the distance between any closest pair of studs, i.e., the width of the opening is larger at the outer end and smaller at the inner end. The openings have a vertical cross-section of a wedged shape defined by the closest pair of studs and the inner and outer rings 14, 15. A plurality of bores (not shown) are formed in both the inner and outer ring walls and each open to the corresponding opening 17 so as to communicate the inner chamber 9 with the outer chamber 10.

Thus the separator 13 is composed of those parts; the inner and outer rings 14, 15, a plurality of studs 16 and a plurality of openings 17. With this arrangement, the separator 13 is provided with a working area large enough to allow a large bulk of material loads to pass therethrough for processing.

As described above, the opening has such a width as being larger towards the outer ring and smaller towards the inner ring so as to keep the material free from clogging and thus ensuring a smooth outward flow of the material of the desired grain size into the outer chamber 10.

Of course, the structure of the separator is not limited to this embodiment, and may be replaced by any structure that satisfies all of the following three conditions; 1) that it is provided with working area large enough for a large bulk of material loads to pass through, 2) that it is free from clogging, and 3) that it has a strong structure enough to endure the operation.

The crushing apparatus also includes an agitator unit 18 having a cylindrical body with one end closed and is disposed in the inner chamber 9 within the vessel 2. The agitator unit 18 is supported rotatable within the chamber 9 and provided with a series of alternating flutes and crowns 19, 20 on the entire length of the outer periphery of the cylindrical body. The flutes are perforated to provide a through-hole or slit 21 so that the feed mixture of the material and the working media will move therethrough in the radial direction to circulate within the vessel 2. A plurality of through-holes 22 are formed in the back wall of the closed end wall of the agitator unit body. The through-holes 22 are arranged at regular intervals along a phantom circle line coaxial of rotation axis of the unit 18.

A tubular hub 23 is formed integrally in the closed back wall of the agitator unit 18. The hub 23 extends outwards from the center of the back wall and coaxially with the rotation axis and is supported rotatable by the bearing 8 mounted in the boss 4 of the vessel body 3. A drive shaft 24 extends through the boss 4 and is also supported rotatable by the bearing 8 fixed in the boss 4. The drive shaft 24 extends further into the hub 23 and the distal end portion (of reduced diameter) is received therein. An agitation head 25 is disposed in the unit 18 and operatively connected to the distal end of the drive shaft 24 by means of a screw and nut system. In this embodiment, the agitation head works as a lock nut.

The agitation head 25 has indentations 26 and ridges 27 formed in alternating orders on the top all around the periphery in order to disperse the material feed mixture, fed through the input port 11 into the inner chamber 9, in the radially outward direction within the vessel 2.

In operation, the drive shaft 24 is first actuated to rotate by a drive means such as motor (not shown), and both the agitator unit 18 and the agitation member simultaneously rotate.

Then a batch of materials is charged into the unit 18 within the inner chamber 9 of the vessel 2 via the input port 11. Thus fed materials and the media are dispersed together with the crushing media radially outwards by the agitation head 25 and then agitated by the agitator unit 18. The crushing media had been charged in the inner chamber 9 in advance.

At this time, the agitated material and the media flow out of the interior or working zone of the unit 18 through the plurality of slits 21 in the cylindrical peripheral wall of the agitator unit 18 due to a strong centrifugal force imparted by the rotation thereof, thereby causing a peripheral flow of the feed of the material and media along the outer periphery of the unit 18.

Then the material feed and the media flowing around the outer periphery of the unit 18 will be subject to a strong shear force by the series of flutes and crowns 19, 20 on the periphery of the unit 18, thereby causing the feed mixture to flow sideways or both in axial directions to reach to the open end of the agitator unit 18 and finally into the working zone of the unit 18 via a gap or opening between the lid 6 and the agitator unit 18. A part of the material feed and the media being forced out of the unit 18 via slits 21 flows through a gap between the unit 18 and the vessel body 3 and then returns into the working zone the through-holes 22. In this manner the material feed flows continuously together with the media within the inner chamber 9 during rotation of the unit 18.

During this circulation within the inner chamber 9, the material feed and crushing media are mixed completely and the material feed is gradually crushed into granulates of a predetermined size. As the feed mixture flow carrying thus obtained granulates of such predetermined grain size moves along the outer periphery of the agitator unit 18, some portion of the mixture flow moves into the separator 13, where the feed mixture is screened and only the granulates are allowed to pass through the openings 17 into the outer chamber 10. Then the properly sized granulates are discharged out of the outer chamber 10 and hence the vessel 2 through the output port 12.

In the present embodiment, L/D ratio of the vessel 2 is set to be relatively small, and D (diameter) is increased to such a degree that L (length) is reduced, so that the apparatus can provide a capacity of the inner chamber (or crushing zone) large enough to process a large bulk of loads. Consequently, the present crushing apparatus enables as much working efficiency as the conventional apparatus which has a relatively longer length (i.e. larger L/D ratio).

The separator 13 is formed into a cylindrical body provided with an arrangement of openings 17 on the periphery and is positioned coaxially with the vessel 2 within the same, thereby allowing for a sufficient working space to process the large bulk of material feed. Therefore the separator will not be a bottleneck of the material feed flow within the vessel 2, thus enabling the apparatus to process the large bulk of loads.

For the structural strength, the separator 13 has an advantage in that the arrangement of plurality of studs 16 are sandwiched between the inner and the outer rings 14, 15. This arrangement reinforces the structure well enough to endure a continuous processing of the large bulk of loads. As a result, the crushing apparatus 1 ensures a long and stable operation over its elongated life span.

Further the agitator unit 18 has the agitation head 25 disposed centrally thereof, a plurality of slits 21 in the peripheral wall thereof and a plurality of through-holes 22 in the back wall thereof both for intercommunication between the interior and exterior thereof as described above. With this arrangement, the apparatus produces a smooth circulation of the material feed and working media broadly within the entire space of the inner chamber 9, thus preventing an undesirable partially accumulated flow of the feed within the vessel 2, which leads to a difficulty in operation or a mechanical failure and therefore ensures a long term stable operation.

Figure 3:
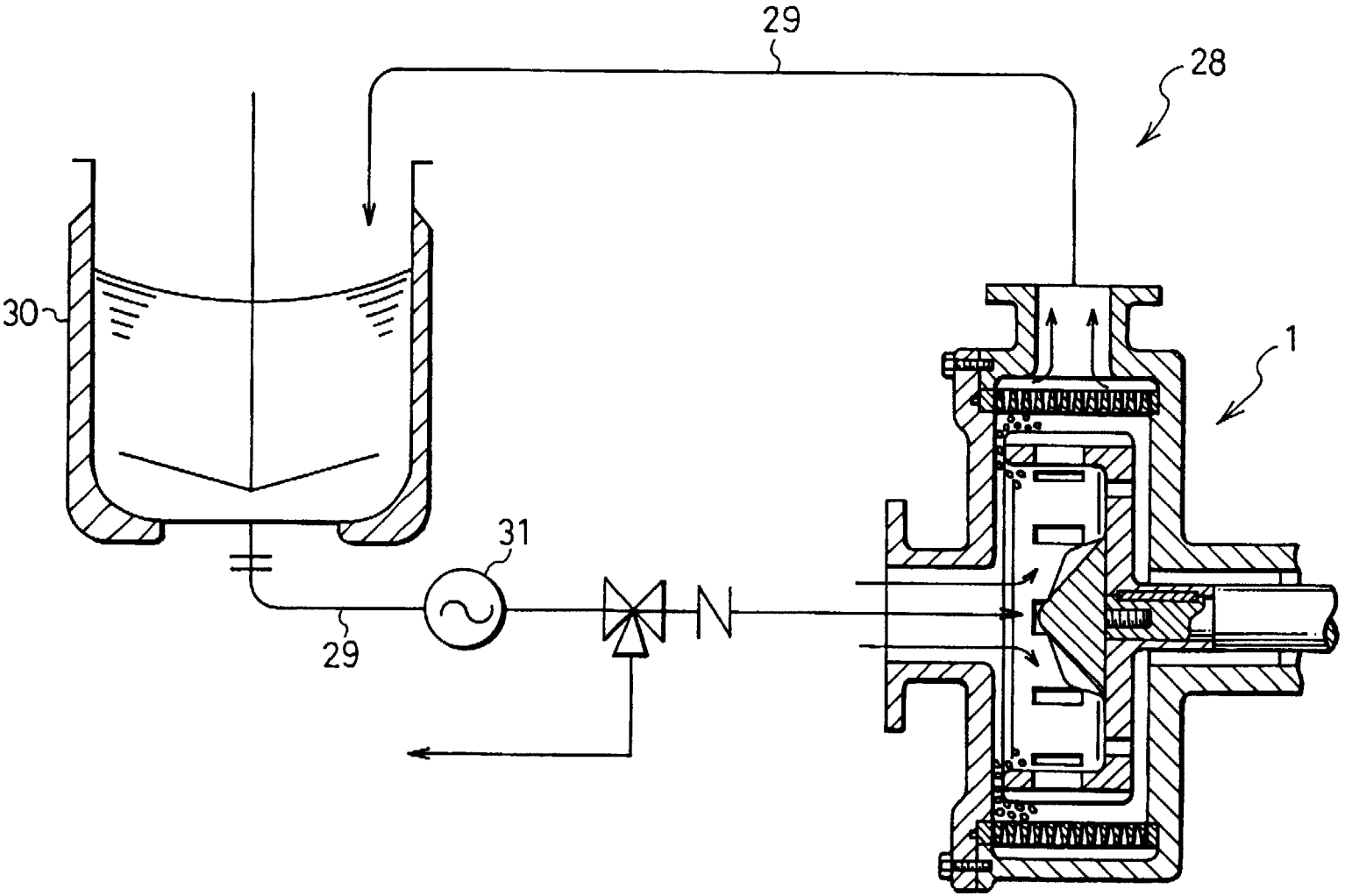
FIG. 3 is a flow diagram of a batch processing mechanism including the crushing apparatus according to the present invention.

FIG. 3 shows a batch processing mechanism 28 including the continuous wet agitating mill or crushing apparatus according to the present invention. The batch processing mechanism comprises the above-described crushing apparatus 1, a material supply tank 30 operatively connected to the crushing apparatus 1 via circulation pipelines 29 and a pump 31 interposed in the circulation line 29 for serving materials to the apparatus 1.

Such mechanism 28 works efficiently for those materials which are hard to be processed or granulated properly in one-time processing, particularly for processing a smaller amount but various types of materials. A number of transferable supply tanks may be prepared and set in service alternatively to improve the productively. For cleaning of the mechanism 1 for a new load of material, a service tank filled with a detergent liquid or rinse may be set in service, thereby conducting a cleaning of the interior of the apparatus 1, the crushing media and circulation pipelines suitably.

With this arrangement, the crushing apparatus work suitably enough to prevent an undesirably accumulated flow of the mixture of material feed and media with in the inner chamber of the vessel.

What is claimed is:

1. A crushing apparatus comprising a crushing vessel of cylindrical configuration having both axial ends substantially closed;

a cylindrical separator disposed within said vessel substantially coaxial therewith, said separator having a plurality of openings disposed on at least some portions of a peripheral wall thereof, said separator parting an interior of said vessel into an inner chamber and an outer chamber disposed coaxially and one inside the other, and said separator being provided with a plurality of bores for intercommunication between said inner chamber and said outer chamber;

an agitator unit disposed rotatably about an axis of said vessel within said inner chamber, said agitator unit having an interior working zone and a plurality of perforations on a peripheral wall thereof;

an input port disposed on said vessel for feeding materials to be processed into said inner chamber; and an output port disposed on said vessel for discharging processed materials out of said outer chambers, wherein said input port also forces the materials into said interior working zone of said agitator unit, said agitator unit forces the materials radially through said perforations of said agitator unit by centrifugal force toward said separator, and said separator allows passage of the processed materials into said outer chamber.

2. A crushing apparatus according to claim 1, wherein a ratio of the length (L) of said vessel in an axial direction to the diameter (D) of said vessel is represented by a formula: $L/D \leqq 1.0$.

3. A crushing apparatus according to claim 1, wherein said agitator unit has a cylindrical body and is provided with a plurality of flutes and crowns disposed on an outer surface of the peripheral wall thereof in alternating fashion.

4. A crushing apparatus according to claim 3, wherein crushing media are provided in said interior working zone and said cylindrical body of said agitator unit is perforated to provide a plurality of through-holes through which the materials and the crushing media flow out of and into said agitator unit.

5. A crushing apparatus according to claim 4, wherein said crushing media is of a predetermined size and said openings of said cylindrical separator are sized so as to prevent passing of said crushing media through said openings.

6. A crushing apparatus according to claim 1, wherein said separator includes an inner cylindrical ring and an outer cylindrical ring with a plurality of studs extending between said inner cylindrical ring and said outer cylindrical ring.

7. A crushing apparatus according to claim 6, wherein said studs are tapered and have a trapezoidal cross-section, said studs defining a plurality of gaps therebetween forming said plurality of openings.

8. A crushing apparatus according to claim 6, wherein said plurality of studs form therebetween said plurality of openings, said plurality of openings being larger toward said outer cylindrical ring than toward said inner cylindrical ring so as to reduce clogging.

9. A crushing apparatus according to claim 1, wherein said agitator unit further comprises an agitation head within said interior working zone, said agitation head having alternating indentations and ridges around a periphery thereof to assist in radial dispersion of said materials.

10. A crushing apparatus comprising a crushing vessel of cylindrical configuration having both axial ends substantially closed;

a cylindrical separator disposed within said vessel substantially coaxial therewith, said separator having a plurality of openings disposed on at least some portions of a peripheral wall thereof, said separator parting an interior of said vessel into an inner chamber and an outer chamber disposed coaxially and one inside the other, and said separator being provided with a plurality of bores for intercommunication between said inner chamber and said outer chamber;

an agitator unit disposed rotatably about an axis of said vessel within said inner chamber, said agitator unit occupying less than all of said inner chamber and having an interior working zone and a plurality of perforations on a peripheral wall thereof, said interior working zone having crushing media provided therein;

an input port disposed on said vessel for feeding materials to be processed into said inner chamber; and an output port disposed on said vessel for discharging processed materials out of said outer chamber, wherein said input port forces the materials into said interior working zone of said agitator unit, said agitator unit forces said materials and said crushing media radially through said perforations of said agitator unit by centrifugal force toward said separator, and said separator allows passage of the processed material into said outer chamber while restricting entry of said crushing media and unprocessed materials into said outer chamber.

11. A crushing apparatus according to claim 10, wherein said agitator unit has a cylindrical body, said cylindrical body being perforated to provide a plurality of through-holes through which the materials and the crushing media flow out of and into said agitator unit.

12. A crushing apparatus according to claim 10, wherein a ratio of the length (L) of said vessel in an axial direction to the diameter (D) of said vessel is represented by a formula: $L/D \leqq 1.0$.

13. A crushing apparatus according to claim 10, wherein said agitator unit has a cylindrical body and is provided with a plurality of flutes and crowns disposed on an outer surface of the peripheral wall thereof in alternating fashion.

14. A crushing apparatus according to claim 10, wherein said crushing media is of a predetermined size and said openings of said cylindrical separator are sized so as to prevent passing of said crushing media through said openings.

15. A crushing apparatus according to claim 10, wherein said separator includes an inner cylindrical ring and an outer cylindrical ring with a plurality of studs extending between said inner cylindrical ring and said outer cylindrical ring.

16. A crushing apparatus according to claim 15, wherein said studs are tapered and have a trapezoidal cross-section, said studs defining a plurality of gaps therebetween forming said plurality of openings.

17. A crushing apparatus according to claim 15, wherein said plurality of studs form therebetween said plurality of openings, said plurality of openings being larger toward said outer cylindrical ring than toward said inner cylindrical ring so as to reduce clogging.

18. A crushing apparatus according to claim 10, wherein said agitator unit further comprises an agitation head within said interior working zone, said agitation head having alternating indentations and ridges around a periphery thereof to assist in radial dispersion of said materials.

* * * * *